US006450595B1

(12) United States Patent
Simon et al.

(10) Patent No.: US 6,450,595 B1
(45) **Date of Patent: *Sep. 17, 2002**

(54) GARMENT-CONCEALABLE JEWELRY CASE HAVING PARALLEL-RUNNING COMPARTMENTS AND INTEGRATED JEWELRY TRAYS FOR STORING AND ORGANIZING JEWELRY

(75) Inventors: Robert M. Simon; Lisa Simon, both of Bloomingburg, NY (US)

(73) Assignee: Gemini Marketing Corporation, Bloomingburg, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/614,933

(22) Filed: Jul. 12, 2000

Related U.S. Application Data

(63) Continuation of application No. 09/325,064, filed on Jun. 3, 1999, now Pat. No. 6,161,686.

(51) Int. Cl.[7] ..... A47B 97/00

(52) U.S. Cl. ..... 312/204; 223/85; 206/6.1; 312/237; 211/85.2

(58) Field of Search ..... 312/204, 237, 312/243; 211/85.2; 220/475; 223/85; 206/6.1, 284, 285, 286, 287, 287.1, 566, 806

(56) References Cited

U.S. PATENT DOCUMENTS

| | | | |
|---|---|---|---|
| D167,836 | S | 9/1952 | Kandarian |
| D239,041 | S | 3/1976 | Rubinstein |
| D247,084 | S | 1/1978 | Demascole et al. |
| 4,134,479 | A | 1/1979 | Crider, Jr. |
| D264,911 | S | 6/1982 | Annis et al. |
| 4,401,219 | A | 8/1983 | Mink |
| 4,413,736 | A | 11/1983 | Nibling |
| 4,620,651 | A | 11/1986 | Spies |
| 4,632,474 | A | 12/1986 | Ingersoll |
| 4,720,987 | A | 1/1988 | Moss |
| 4,735,246 | A | 4/1988 | Niehaus |
| 4,776,650 | A | 10/1988 | Ferenzi |
| 4,848,585 | A | 7/1989 | Snyder |

(List continued on next page.)

*Primary Examiner*—Peter M. Cuomo
*Assistant Examiner*—Jerry A. Anderson
(74) *Attorney, Agent, or Firm*—Thomas J. Perkowski, Esq., P.C.

(57) ABSTRACT

A garment-concealable jewelry case having a front opening with a front cover panel portion that can be either moved or configured to reveal a plurality of parallel-running isolated storage compartments each having an interior storage space which is accessible through a front opening revealed when the front cover panel is removed or reconfigured. Through the front opening of each storage compartment, one or more necklaces, pendants, bracelets or other strands of jewelry can be securely hung on a pair of jewelry support posts adapted for spatial separation on the back wall portion of the storage compartment in order to accommodate the length of jewelry strands being supported. The bottom portion of each parallel-running isolated compartment has a stationary front panel portion which, cooperating with the other wall portions of the storage compartment, provides a five sided stationary storage tray accessible through the opening of the respective storage compartment and within which articles of jewelry such as rings, watches, earrings and/or tie tacks can be placed for organization and storage. The front cover panel has a tray cover panel integrated therewith, which closes off each jewelry storage compartment when the front cover panel is positioned over the access opening formed in the case housing. When the front cover panel is closed, the jewelry support posts contact the rear surface of the front cover panel to prevent supported articles of jewelry from falling off and tossing about within the storage compartment during usage, including travel.

36 Claims, 7 Drawing Sheets

U.S. PATENT DOCUMENTS

| | | | |
|---|---|---|---|
| 4,850,658 | A | 7/1989 | Sandor |
| 4,854,656 | A | 8/1989 | O'Keefe |
| 4,966,287 | A | 10/1990 | Snyder |
| 4,978,001 | A | 12/1990 | Nelson |
| D313,906 | S | 1/1991 | Lublin |
| 5,117,988 | A | 6/1992 | Daniels |
| 5,141,113 | A | 8/1992 | Elliott |
| 5,209,344 | A | 5/1993 | Smith |
| 5,242,048 | A | 9/1993 | Ellingworth |
| 5,246,103 | A | 9/1993 | Hicks |
| 5,295,587 | A | 3/1994 | Downes et al. |
| 5,303,855 | A | 4/1994 | Veale |
| 5,333,727 | A | 8/1994 | Hoppe |
| 5,363,953 | A | 11/1994 | Carter |
| 5,370,453 | A | 12/1994 | Wolff |
| D357,034 | S | 4/1995 | King |
| 5,427,230 | A | 6/1995 | Mattox |
| 5,449,073 | A | 9/1995 | DeBeverly |
| 5,452,806 | A | 9/1995 | Campas |
| 5,509,588 | A | 4/1996 | Kimball |
| 5,511,873 | A | 4/1996 | Mech |
| 5,526,968 | A | 6/1996 | Larson |
| 5,617,948 | A | 4/1997 | Rainey |
| 5,664,669 | A | 9/1997 | Fleet |

GARMENT-CONCEALABLE JEWELRY CASE HAVING PARALLEL-RUNNING COMPARTMENTS AND INTEGRATED JEWELRY TRAYS FOR STORING AND ORGANIZING JEWELRY

RELATED CASES

This is a continuation of copending application Ser. No. 09/325,064 filed Jun. 3, 1999, now U.S. Pat. No. 6,161,686.

BACKGROUND OF THE INVENTION

1. Field of Invention

The present invention relates to an improved device for storing and organizing articles of jewelry including necklaces and bracelets.

2. Brief Description of the Prior Art

For ages, jewelry such as necklaces, bracelets, rings and pendants, have been worn by men and women alike for ornamental and symbolic reasons alike.

When not being not worn, such jewelry is typically placed into a storage case for safe keeping. Over the years, numerous different types of jewelry storage cases have been developed. Examples of such prior art jewelry cases are disclosed in U.S. Pat. Nos. 4,401,219; 4,620,651; 4,720,987; 4,848,585; 4,854,656; 5,246,103; 5,246,103; 5,295,587; 5,427,230; Des. 167,836; and Des. 247,084, each being incorporated herein by reference.

U.S. Pat. Nos. 4,848,585, 4,854,656, 5,246,103 teach how to make jewelry cases for storing necklaces in a way that prevents tangling.

U.S. Pat. Nos. 4,620,651 and 4,401,219 teach how prior art jewelry cases are concealed by garments and stored in a clothes closet. However, such prior art jewelry cases have suffered from a number of shortcomings and drawbacks so as to not be commercially practical In particular, prior art necklace holder and organizer designs, configured in the shape of clothes hangers, are generally heavy, flimsy, space consuming, unattractive, expensive to manufacture, and fail to maintain necklaces in a tangle-free configuration if the organizer is tipped or tilted during movement or transportation operations.

In addition, such prior art necklace holder and organizer designs often tend to catch on clothes used to conceal the same.

Thus, there is a great need in the art for an improved device for storing and organizing articles of jewelry in a way and using a means that overcomes the shortcomings and drawbacks or prior art devices.

OBJECTS AND SUMMARY OF THE INVENTION

A primary object of the present invention is to provide an improved device for storing and organizing articles of jewelry in a way and using a means that overcomes the shortcomings and drawbacks of prior art devices.

Another object of the present invention is to provide a garment-concealable jewelry case having a front opening with a front cover panel portion that can be either moved or configured to reveal a plurality of parallel-running isolated storage compartments each having an interior storage space which is accessible through a front opening revealed when the front cover panel is removed or reconfigured.

Another object of the present invention is to provide such a garment-concealable jewelry case, wherein through the front opening of each storage compartment, one or more necklaces, pendants, bracelets or other strands of jewelry can be securely hung on a pair of jewelry support posts adapted for spatial separation on the back wall portion of the storage compartment in order to accommodate the length of jewelry strands being supported.

Another object of the present is to provide such a garment-concealable jewelry case, wherein each jewelry post contacts the rear surface of the front cover panel in order to prevent supported articles of jewelry from sliding or otherwise falling off the support post when the front cover panel is closed and the jewelry case is being transported or otherwise subjected to external forces, as experienced when moving clothes around in a closet environment.

Another object of the present invention is to provide such a garment-concealable jewelry case, wherein the bottom portion of each parallel-running isolated compartment has a stationary front panel portion which, cooperating with the other wall portions of the storage compartment, provides a five sided stationary storage tray accessible through the opening of the respective storage compartment and within which articles of jewelry such as rings, watches, earrings and/or tie tacks can be placed for organization and storage.

Another object of the present invention is to provide such a garment-concealable jewelry case, wherein the front cover panel has a tray cover panel integrated therewithin, which closes off each jewelry storage compartment when the front cover panel is positioned over the access opening formed in the case housing.

Another object of the present invention is to provide such a garment-concealable jewelry case, in which security is obtained by concealment rather than by locking mechanisms.

Another object of the present invention is to provide such a garment concealable jewelry case, wherein its housing or casing has a form factor that is substantially free of sharp outer edges which tend to get snagged, and its support hook can be removed or collapsed during travel operations.

Another object of the present invention is to provide such a garment-concealable jewelry case, wherein the front cover panel can be easily opened to reveal organized articles of jewelry when the case is lying flat in a suitcase.

Another object of the present invention is to provide such a garment-concealable jewelry case having a very thin housing portion that is dimensioned so that a shirt, blouse or coat can be fitted or draped thereover to cover the storage case when it is hung inside a closet from its removable/collapsible support hook.

Another object of the present invention is to provide such a garment-concealable jewelry case, wherein the interior of each storage compartment is lined with material which presents necklaces and other jewelry articles from scratching.

Another object of the present invention is to provide such a garment concealable jewelry case, which is designed to swivel about its support hook within a closet so as to face the user and enable easy access to the articles of jewelry supported therewithin.

Another object of the present invention is to provide such garment-concealable jewelry case, which is made from a durable colored plastic that is easy to clean.

These and other objects of the present invention will become apparent hereinafter and in the Claims to Invention staked out hereinbelow.

BRIEF DESCRIPTION OF DRAWINGS

For a fuller understanding of the objects of the present invention, the following Detailed Description of The Illustrative Embodiments shall be read in conjunction with the accompanying drawings, wherein.

DETAILED DESCRIPTION OF THE ILLUSTRATIVE EMBODIMENT

Figure 1:
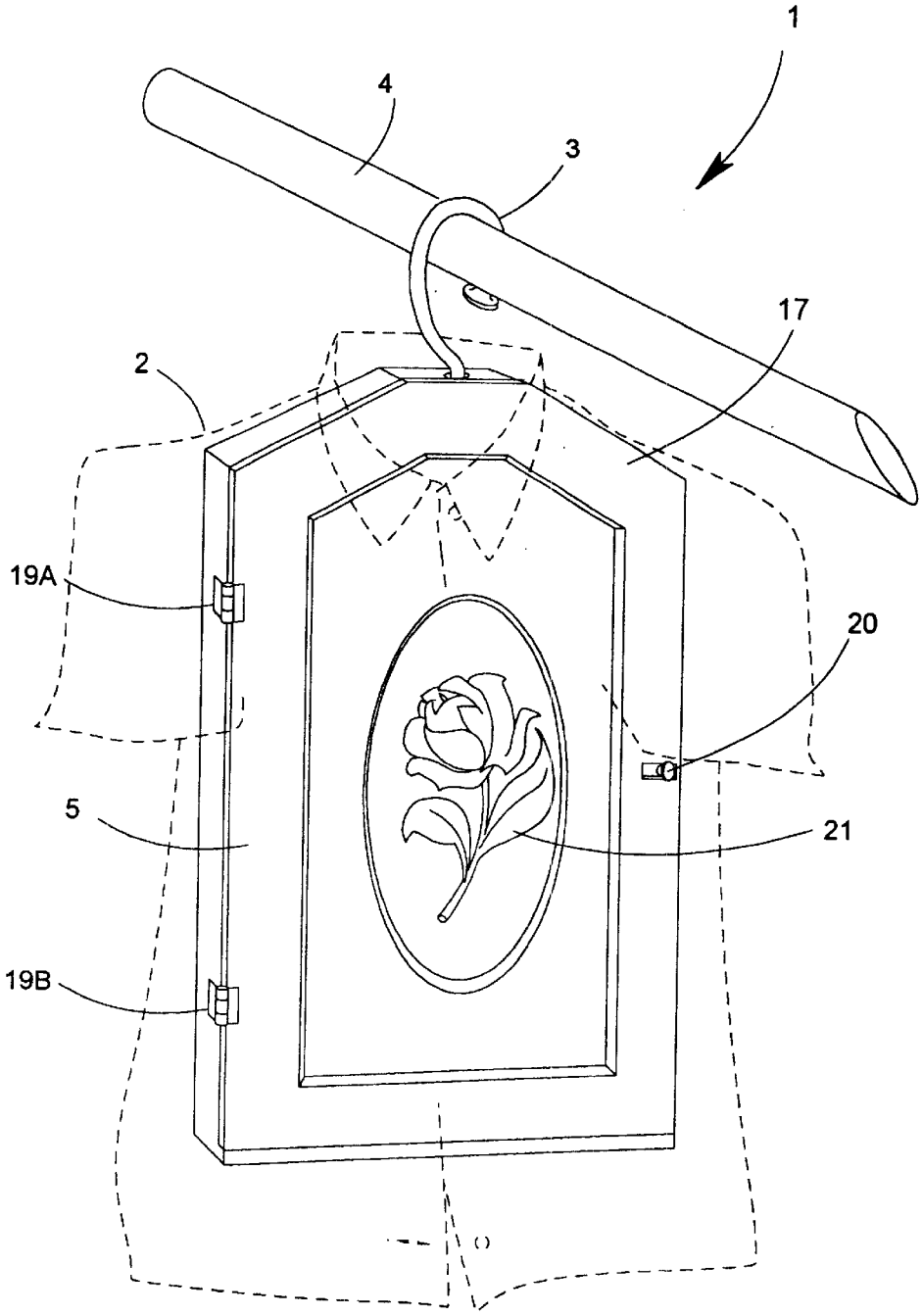
FIG. 1 is a perspective view of the garment-concealable jewelry case of the first illustrative embodiment of the present invention, shown supported from a closet rod, with the front cover panel thereof arranged in its closed configuration, and a phantom view of a blouse or like garment supported thereover to conceal the jewelry case among other garments supported from the closet rod.

Referring now to the accompanying Drawings, the Detailed Description of the Illustrative Embodiment will now be described in detail hereinbelow, wherein like elements shall be denoted by like reference numerals.

As shown in FIG. 1, the jewelry case of the illustrative embodiment of the present invention indicated by reference numeral 1 has a very thin housing that is dimensioned so that a shirt, blouse or coat 2 (depicted in dotted lines) can be fitted thereover to cover the storage case when it is hung from its retractable/projectable support hook 3 on a closet rod 4 supported inside a clothes closet. In the illustrative embodiments, the case housing 5 has maximum length dimension of about 18.5 inches, a maximum width dimension of about 11 inches, and a depth (i.e. thickness) dimension of about 1.0 inch or less, to provide an ultra-thin low-height profile design that is easily concealed under a short, blouse or coat. Preferably, the case housing is made from a lightweight, yet durable plastic material of a designed coloring and surface texture using injection-molding techniques well known in the art.

Figure 2:
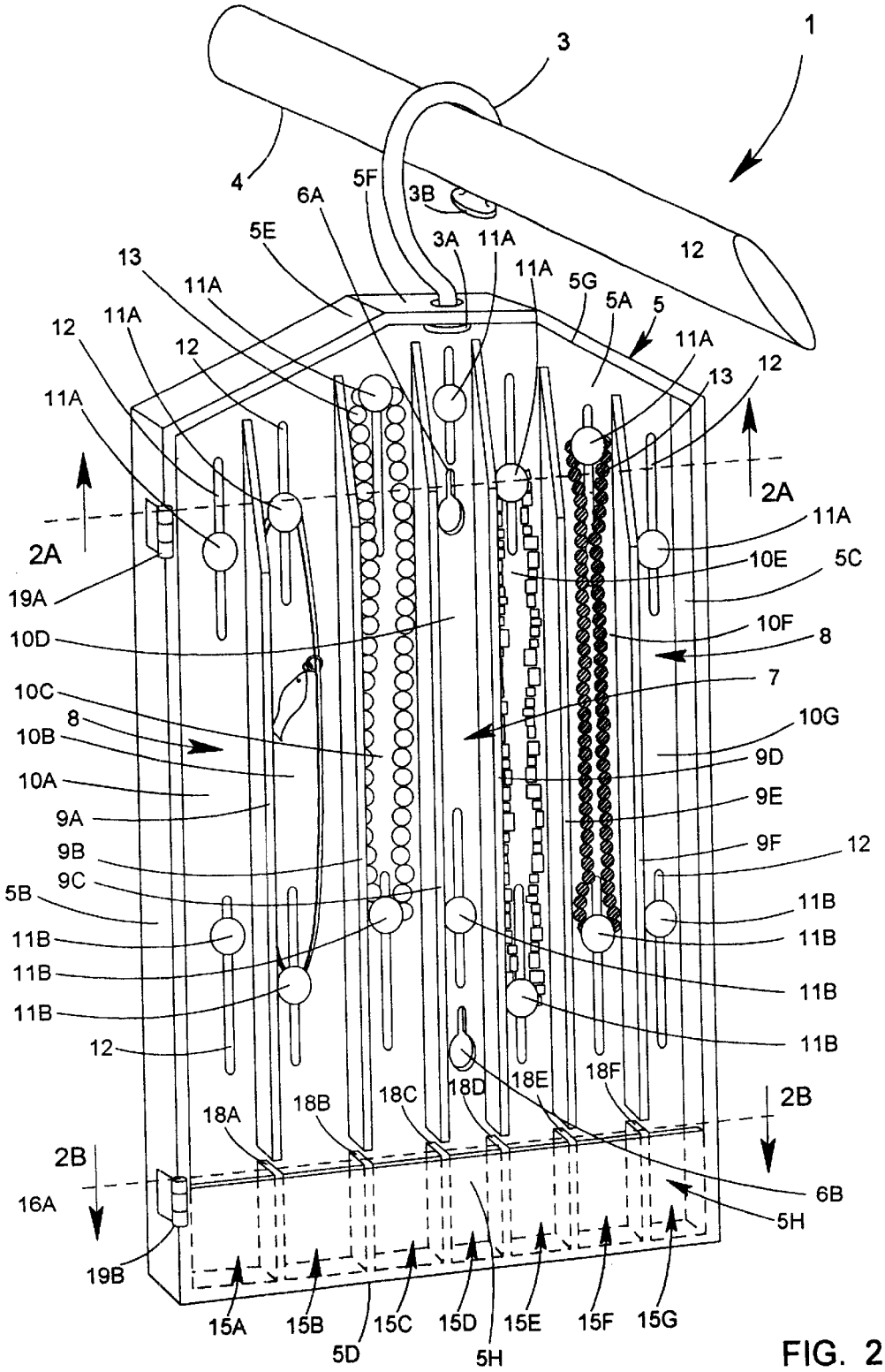
FIG. 2 is a perspective view of the garment-concealable jewelry case of FIG. 1, shown with the front cover panel thereof removed to fully reveal its plurality of parallel-running jewelry storage compartments and integrated jewelry storage trays.

As shown in FIG. 2, the case housing 5 has a form factor for supporting, and being substantially concealed by a garment such as a shirt, blouse, coat, robe or like article of clothing. In the illustrative embodiment, the case housing 5 number of housing portions, namely: a back panel portion 5A having a pair of holes 6A and 6B formed therein for optional mounting of the case on a wall surface using a pair of screws; a pair of side wall portions 5B and 5C extending from the back wall portion 5A: a bottom wall portion 5D extending from said back wall portion and connected to the side wall portions 5B and 5C; top wall portions 5E, 5F and 5G extending from and connected to the back wall portion 5A and portions 5E and 5G being connected to the side wall portions 5B and 5C, respectively, so as to define an interior volume 7 having an access opening 8; a fixed front wall portion 54 connected to the bottom wall portion 5D, and disposed substantially parallel to the back wall portion 5A, and extending between the side wall portions 5B and 5C, beneath the access opening 8; six thin wall-like partition panels 9A and 9E projecting from the back wall panel 5A and running in a parallel manner within the interior volume 7 so as to form a plurality of jewelry storage compartments 10A through 10G therewithin.

Figure 2A:
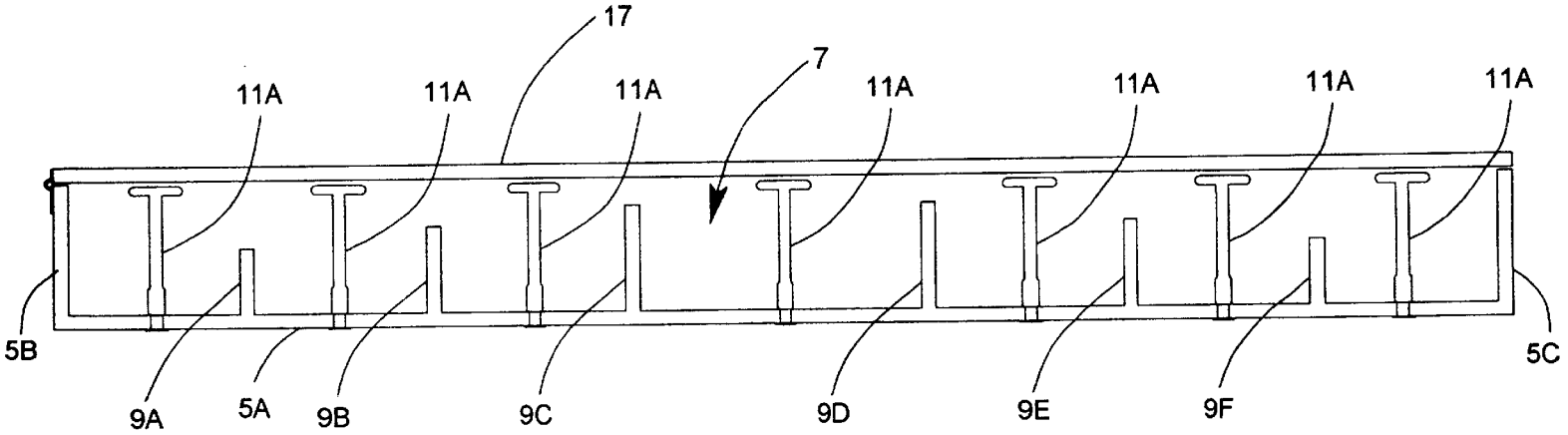
FIG. 2A is a cross-sectional view of the garment-concealable jewelry case of FIG. 2, taken along line 2A—2A in FIG. 2, showing the pair of position-adjustable jewelry support posts mounted within each parallel-extending jewelry storage compartment provided therein.
Figure 2B:
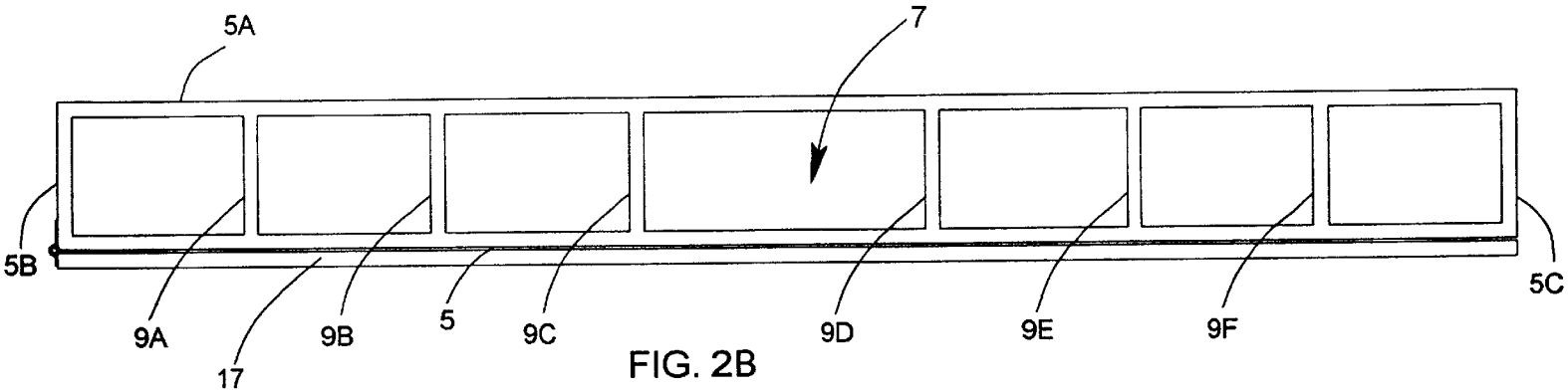
FIG. 2B is a cross-sectional view of the garment-concealable jewelry case of FIG. 2, taken along line 2A—2A in FIG. 2, showing the jewelry storage case integrated within each parallel-extending jewelry storage compartment provided therein.

As shown in FIG. 2, each jewelry storage compartment has a pair of jewelry support posts 11A and 11B that can be adjustably spaced apart by the user pulling each support post by its disc-like flange and sliding it into a desired position within the storage compartment, in a lock-fit manner. As shown in FIG. 2A, when front cover panel 17 is closed, each jewelry post 11A and 11B contacts the rear surface thereof in order to prevent supported articles of jewelry from sliding or otherwise falling off the support posts 11A and 11B, and tossing about within the storage compartment when, for example, the jewelry case is being transported from one location to another, or when subjected to external forces when moving clothes around in a closet environment.

Notably, each jewelry post 11A and 11B within each jewelry storage compartment is provided with a releasable lock mechanism. One way of realizing the releasable lock mechanism is to provide each support post with teeth or projections on the bottom portion thereof (adjacent to the back panel portion 5A) and spring biasing the support post 11A(11B) so that it can be pulled upwardly (against string forces) to release the teeth or projections from holes formed within the back panel portion 5A. With this arrangement, each support post can be repositioned along the length of the respective jewelry storage compartment, as required to support a necklace or bracelet of a particular length. Alternatively, the releasable lock mechanism can be realized by equipping the bottom of each spring-biased support post with teeth or like projections that lock into detents formed along a slot 12 formed along the vertical extent of the back panel portion 5A.

The above-described support post position-adjustment mechanisms are easy to use. First, a necklace or bracelet 13 of a particular length is supported over the top or upper support post 11A and then the lower or bottom support post 11B is slide into position to as to take up the slack in the necklace or bracelet between the support posts. In this supported configuration, the necklace or bracelet should be taut, but not tight to create excessive strain therealong. In a preferred embodiments disclosed herein, support posts 11A and 11B can each be repositioned within its parallel-extending jewelry storage compartment.

As shown in FIG. 2, each end of hook 3 is provided with a disc-like flange 3A and 3B integrated with the body of the hook. The function of these flanges is to prevent either end of the hook from falling through the hole formed in the top side panel 5F, and thus prevents the retractable/projectable hook 3 from detaching from its case housing and becoming lost while traveling. It is understood, however, that there are many other alternative ways of realizing a hook structure for supporting the case housing 5 from a closet rod 4 or like support structure. In some embodiments, it may be desirable to make the hook structure 3 detachable from the case housing or reconfigurable therewith in some manner.

As shown in FIG. 2, each storage compartment 10A and 10G also has an integrated jewelry storage tray 15A through 15G, respectively, for storing articles of jewelry such as rings, earrings, pendants, tie clips, cufflinks, etc. In particular, the first jewelry storage compartment 10A has a first integrated storage tray 15A formed by bottom wall portion 5D side wall portion 5B, partition panel 9A, and front wall portion 5H; the second jewelry storage compartment 10B has integrated storage tray 15B formed by bottom wall portion 5D, partition panels 9A and 9B, and front wall portion 5H; the third storage compartment 10C has integrated storage tray 15C formed by bottom wall portion 5D, partition panels 9B and 9C, and front wall portion 5H; the fourth storage compartment 10D has integrated storage tray 15D formed by bottom wall portion 5D, partition panels 9C and 9D, and front wall portion 5H; the fifth storage compartment 10E has integrated storage tray 15E formed by bottom wall portion 5D, partition panels 9D and 9E, and front wall portion 5H; the sixth storage compartment 10F has integrated storage tray 15F formed by bottom wall portion 5D, partition panels 9F and 9F, and front wall portion 5H; and the seventh storage compartment 10G has integrated storage tray 15G formed by bottom wall portion 5D, side wall portion 5C, partition panel 9F, and front wall portion 5H. Notably, each jewelry storage tray 15A through 15G is stationary and integrated within the bottom portion of its respective jewelry storage compartment 10A through 10.

Figure 2C:
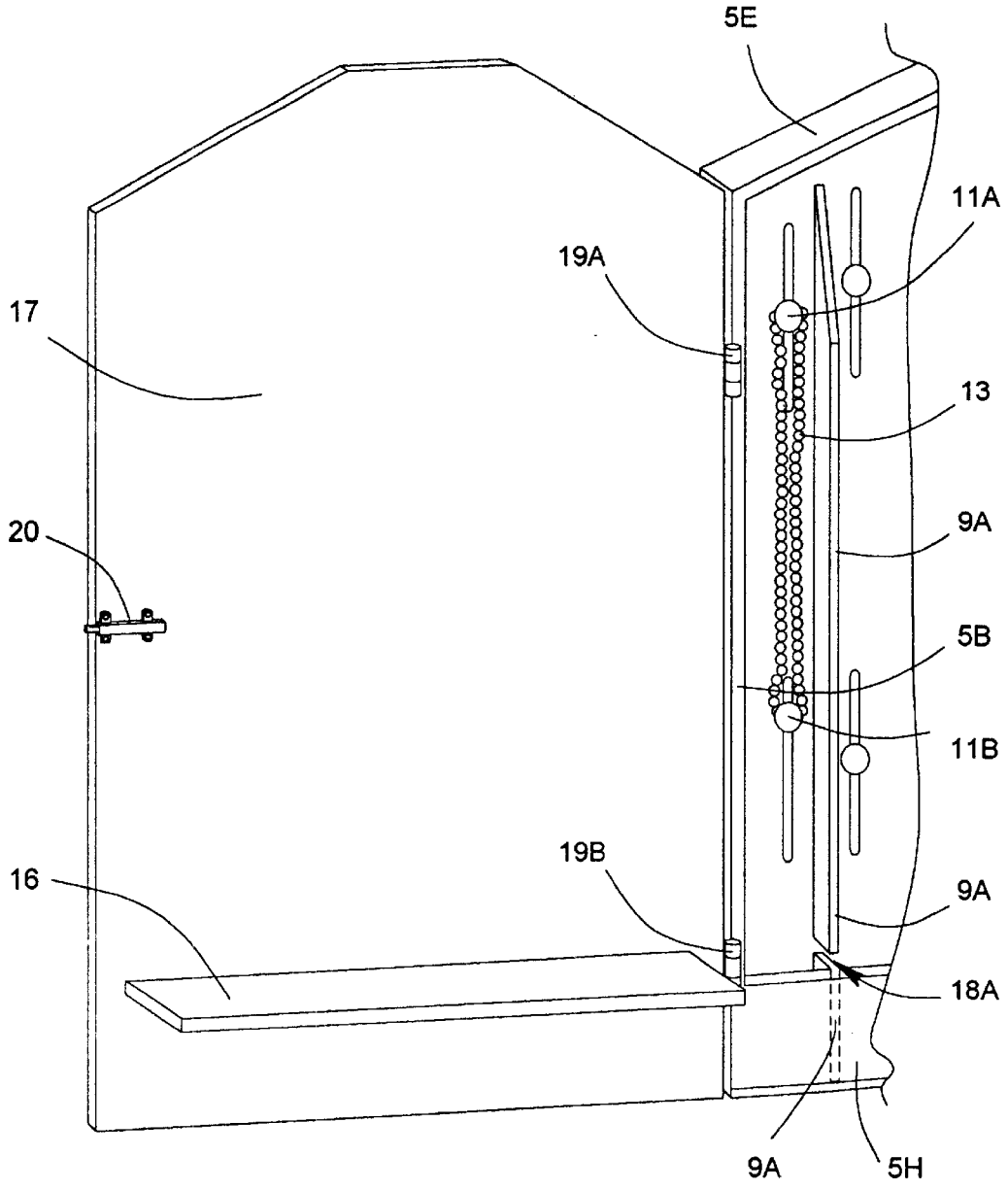
FIG. 2C is a perspective, partially cut-away view of garment-concealable jewelry case of FIG. 1, showing its front cover panel arranged in its open position, and the tray cover panel extending from the lower inside surface thereof being withdrawn from the slots formed within the partition panels of the storage compartments, slightly above the front wall portion of the case housing.

As shown in FIG. 2C, a single tray cover panel 16 extending from the lower inside surface of front cover panel 17 passes through slots 18A through 18C formed in partition panels 9A through 9F, respectively, and fits over the top openings formed in each of the integrated jewelry storage trays 15A through 15G. When the front cover panel 17 is installed in place, as shown in FIG. 1, then each of the integrated jewelry storage trays 15A through 15G are closed or otherwise concealed by a portion of the tray cover panel 16, thereby safely containing any articles of jewelry, e.g. stored therewithin.

As shown in FIG. 2, the upper portion of each of the partition structures is tapered so as to facilitate the hanging of necklaces and bracelets from the upper support post within the respective storage compartment. Also, the interior of each jewelry storage compartment and tray is lined with a velvet-like textured material in order to reduce scratching of necklaces and other jewelry articles contained within the case.

When the jewelry case of the present invention is used in a wardrobe or clothes closet, its case housing 5 can be rotated a full 360 degrees about its support hook 3 so that the front cover panel 17 is substantially parallel with a plane through which the closet rod 4 is disposed, making the jewelry case easily accessible even in spatially cramped environments. The front cover panel 17 can then be rotated about its hinges 19A and 19B, as shown partly in FIG. 2C, to reveal the plurality of parallel-running isolated storage compartments 10A through 10G. In this configuration, one or more necklaces, pendants, bracelets and other strands of jewelry can be securely hung on the pair of jewelry support posts located within each jewelry storage compartment. Also, in this configuration, the tray cover panel 16, extending from the inside surface of the front cover panel 17, is withdrawn from the plurality of slots 18A through 18F formed within the thin compartment partition panels 9A through 9F, slightly above the front bottom panel 5H, as best shown in FIG. 2.

When the front door panel is closed, as shown in FIG. 1, the tray cover panel 16 is disposed within the slots 18A through 18F and cover each of the integrated jewelry trays 15A through 15G, in order to securely retain loose articles of jewelry, such as rings, watches, earrings and/or tie tacks, therewithin during storage, transport and like operations. Also, as shown in FIG. 2A, each jewelry support post 11A and 11B contacts the rear surface of the front cover panel 17 in order to prevent supported articles of jewelry from sliding or otherwise falling off the support post when the front cover panel is closed and the jewelry case is being transported or otherwise subjected to external forces, as experienced when moving clothes around in a closet environment.

A snap-type locking mechanism 20 (or other mechanism) can be provided to prevent the cover panel 17 from opening in its closed configuration. In this configuration, a garment can be fitted over the case housing, as in the case of outfitting a mannequin, so as to conceal the jewelry case. Thereafter, the outfitted jewelry case can be tucked away among other articles of clothing hanging within the closet. While this method provides a measure of security provided over the jewelry by concealment, rather than by locking mechanisms, it is understood that locking mechanism may be provided on the jewelry case to hinder theft and/or tampering with articles of jewelry contained therewithin.

Figure 3:
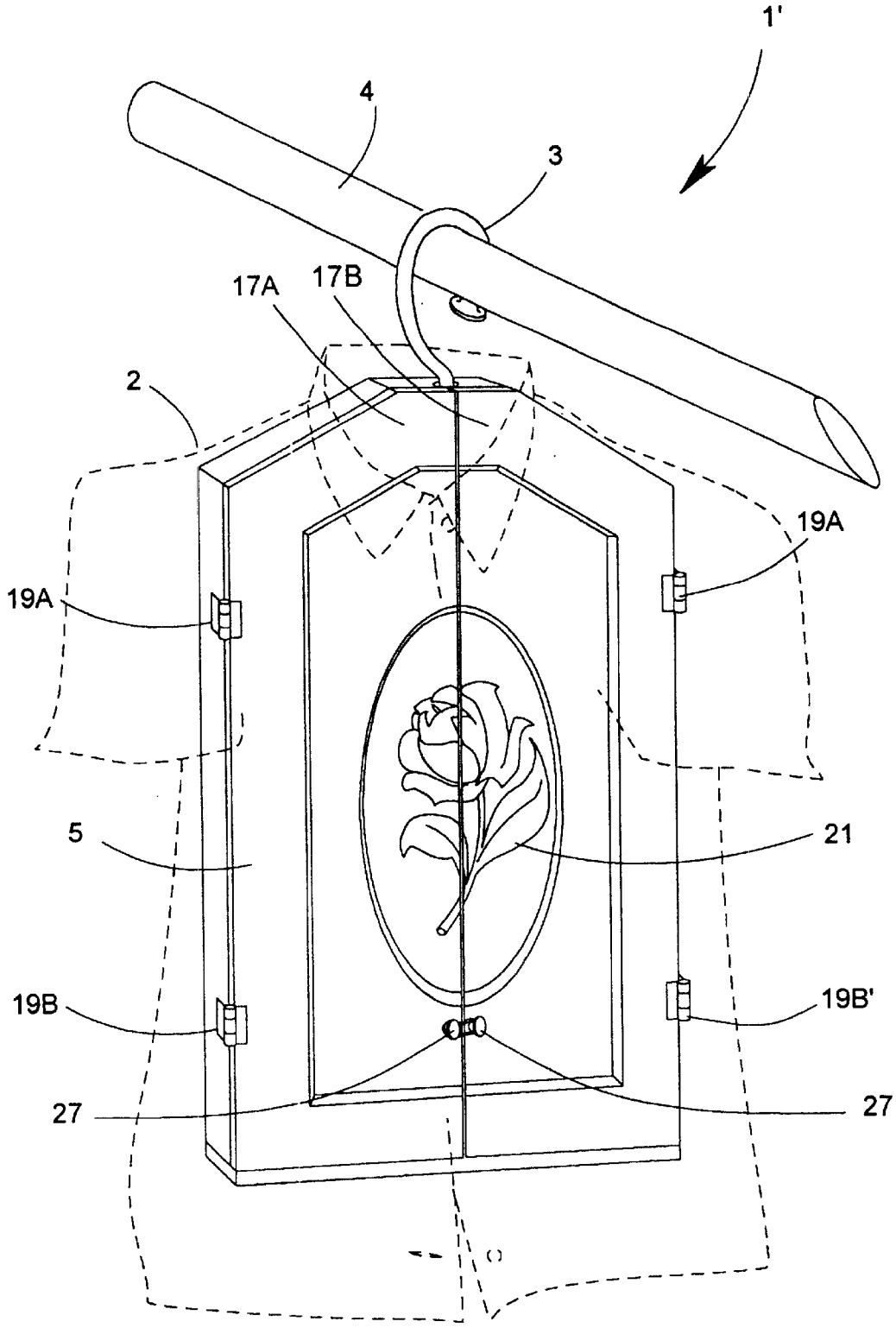
FIG. 3 is a perspective view of the garment-concealable jewelry case of the second illustrative embodiment of the present invention, shown supported from a closet rod, with its left and right front cover panels arranged in its closed configuration.
Figure 3A:
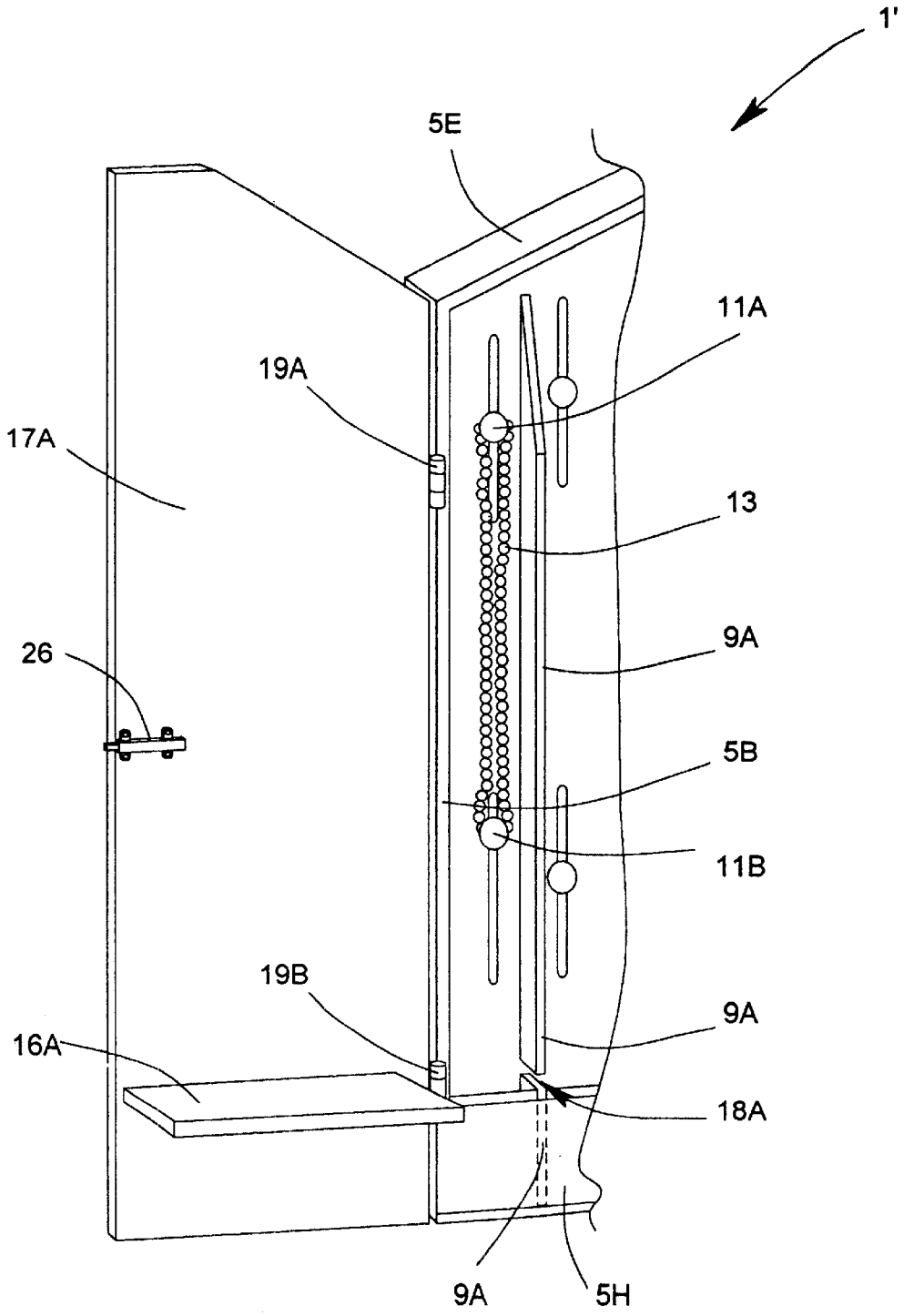
FIG. 3A is a perspective, partially cut-away view of garment-concealable jewelry case of FIG. 3, showing its left front cover panel arranged in its open position, and the tray cover panel extending from the lower inside surface thereof being withdrawn from the slots formed within the partition panels of the storage compartments, slightly above the front wall portion of the case housing.
Figure 4:
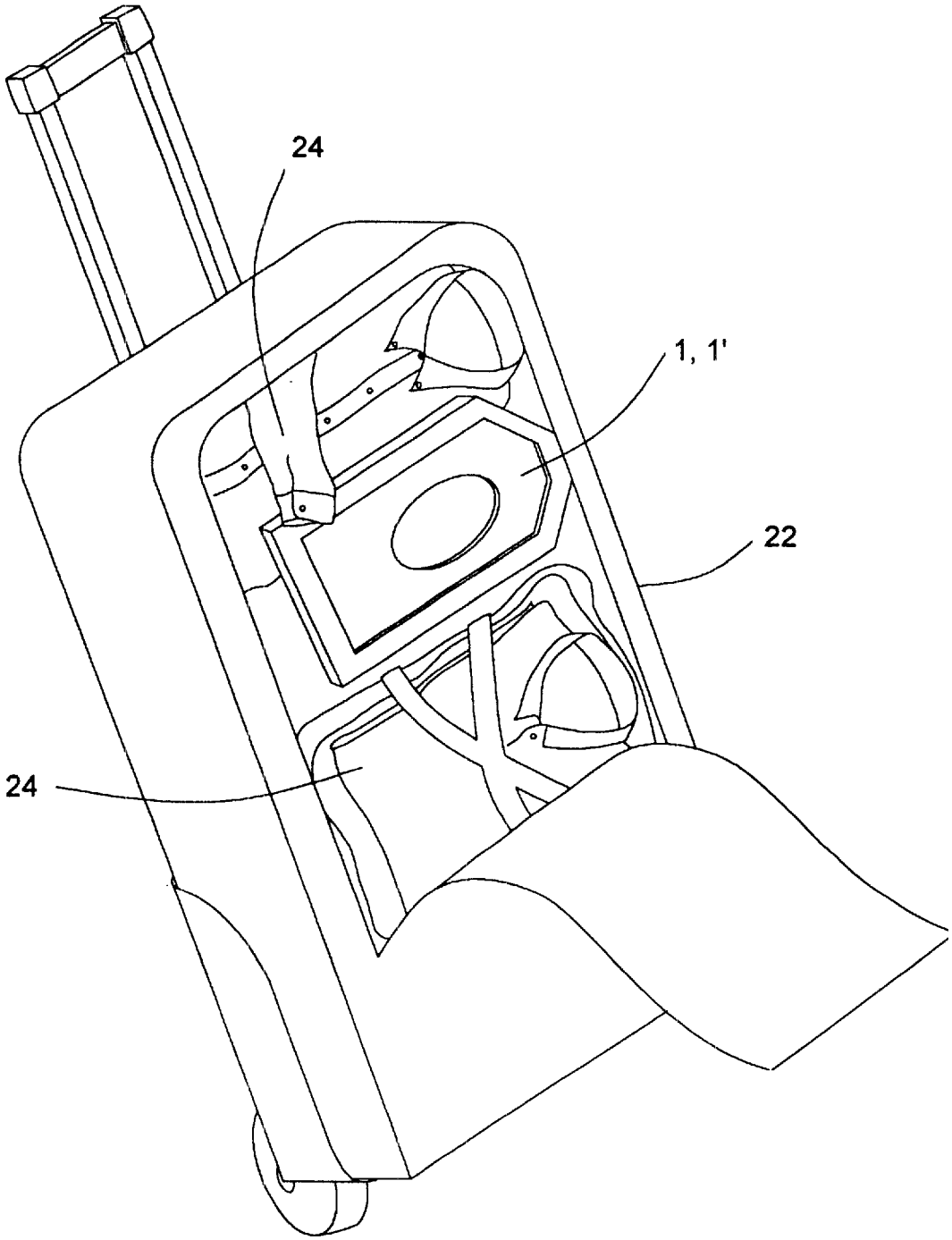
FIG. 4 is a perspective view of the garment-concealable jewelry case of the present invention, shown packed within a conventional top-opening suitcase.

In FIG. 3, a second illustrative embodiment of the present invention is shown. In this alternative embodiment, jewelry case 1' has a front cover panel structure that is realized as a pair of front cover panel doors 17A and 17B. As shown, each panel door is hingedly connected to an other edge of the case housing by a pair of hinges 19A, 19B (and 19A', 19B'). Also as shown in FIG. 3A, front cover panel 17A has a storage tray cover panel 16A extending from the lower rear surface thereof and closing off the first half of the integrated storage tray compartments formed within the case housing. Likewise, front cover panel 17B has a storage tray cover panel 16B extending from the lower rear surface thereof and closing off the second of the integrated storage tray compartments formed within the case housing. In all other respects, jewelry case 1' is similar to jewelry case 1 described in detail hereinabove. When the front cover panel doors 17A and 17B are arranged in their closed configuration, as shown in FIG. 3, the free edges thereof meet along the centerline of the case housing and can be locked together by a releasable locking mechanism 26. A pair of small knobs, or recessed pull-grips 27, can be provided to or formed on the front doors 17A and 17B so as to facilitate opening and closing of these front panels.

Notably, the housing of the jewelry cases disclosed herein have a form factor that is substantially free of sharp outer edges so that it does not get snagged on articles of clothing. This makes the jewelry device suitable for carrying within a suitcase or article of luggage during travel operations. In such applications, the jewelry case of the present invention 1 (or 1') can be lifted off the closet rod, and the support hook 3 easily retracted within the case housing (e.g. by pushing and wrangling it through to the inside of the case housing).

The jewelry case 1 (or 1') can then be packed in a horizontal manner within a suitcase or piece of opened luggage 22, as shown in FIG. 3. Other articles of clothing 24 can be packed over and about the device to conceal the same. Alternatively, the jewelry case of the present invention can be mounted against a closet wall via a pair of holes formed in the rear panel of the storage case. In this arrangement, however, concealment of the storage case within a shirt, blouse or coat, will not be possible in the manner shown in FIG. 1.

Ornamentation 21 or other decorative graphics, inscription and/or designs can be provided to the front surface of the front cover panel 17 (or front cover panels 17A and 17B) to enhance the appearance thereof.

The jewelry case of the present invention can be modified in a variety of ways to adapt to any particular application at hand. In the illustrative embodiments described above, the front cover panel 17 (and 17A, 17B) are realized using hingedly connected front cover panels. However, in alternative embodiments of the present invention, the front cover panel can be designed to lift off of the case housing entirely, or slid thereonto in a horizontal or possibly vertical manner.

Such modifications described above are merely exemplary. It is understood that other modifications to the illustrative embodiments will readily occur to persons with ordinary skill in the art. All such modifications and variations are deemed to be within the scope and spirit of the present invention as defined by the accompanying Claims to Invention.

What is claimed is:

1. A jewelry case for storing and organizing articles of jewelry, comprising:

a case housing having a form factor for supporting, and being substantially concealed by a garment, said case housing having a number of housing portions including a back panel portion, a pair of side wall portions extending from the connected to said back wall portion, a bottom wall portion extending from and connected to said side wall portions, a top wall portion extending from and connected to said bottom wall portion and also being connected to said side wall portions so as to define an interior volume having an access opening, and a fixed front wall portion connected to said bottom wall portion, and disposed substantially parallel to said back wall portion, and extending between said side wall portions, beneath said access opening;

a plurality of partition panels projecting from said back wall panel and running in a parallel manner within said interior volume so as to form a plurality of jewelry storage compartments therewithin;

wherein each said jewelry storage compartment has at least one support post for supporting one or more strands of jewelry;

wherein each said jewelry storage compartment has a jewelry storage tray integrated therewith beneath said fixed front wall portion for storage of jewelry items;

a support hook, connected to said case housing, for supporting said case housing from a closet rod; and a front cover panel for positioning over said access opening so as to close off said interior volume and cover said plurality of jewelry storage compartments and said plurality of jewelry storage trays.

2. The jewelry case of claim 1, wherein each said partition panel has a slot formed therein slightly above said fixed front wall portion, and said front cover panel has a tray cover panel projecting orthogonally from the bottom inside surface thereof and slides into said slots formed within said partition panels when said front cover panel is positioned over said access opening, thereby closing off and containing articles of jewelry placed within each said jewelry storage tray.

3. The jewelry case of claim 2, wherein said front cover panel is hingedly connected to said case housing.

4. The jewelry of claim 1, wherein each said jewelry storage compartment comprises a pair of spaced apart support posts mounted to said back wall portion, for supporting strands of jewelry.

5. The jewelry case of claim 4, where the distance between said pair of support posts within each said jewelry storage compartment is user adjustable to accommodate the length of said jewelry strands being supported on said support posts.

6. The jewelry case of claim 1, wherein the upper portion of each said partition panel is tapered to facilitate placement of jewelry strands about said support post within said jewelry storage compartment.

7. The jewelry case of claim 1, wherein said support hook is detachable from said case housing.

8. The jewelry case of claim 1, wherein the surfaces bounded within each said jewelry storage compartment are provided with a soft-textured material to reduce scratching of articles of jewelry stored therewithin.

9. The jewelry case of claim 1, wherein said back panel is further provided with at least one mounting hole for passage of a screw to mount said case housing to a wall surface.

10. The jewelry case of claim 1, wherein each support post contacts the rear surface of said front cover panel in order to prevent supported articles of jewelry from sliding off said support post when said front cover panel is closed and said jewelry case is being transported or otherwise subjected to external forces, as experienced when moving clothes around in a closet environment.

11. A jewelry case for storing and organizing articles of jewelry, comprising:

a case housing having a form factor for supporting, and being substantially concealed by a garment, said case housing having a number of housing portions including a back panel portion, a pair of side wall portions extending from and connected to said back wall portion, a bottom wall portion extending from and connected to said side wall portions, a top wall portion extending from and connected to said bottom wall portion and also being connected to said side wall portions so as to define an interior volume having an access opening, and a fixed front wall portion connected to said bottom wall portion, and disposed substantially parallel to said back wall portion, and extending between said side wall portions, beneath said access opening;

a plurality of partition panels projecting from said back wall panel and running in a parallel manner within said interior volume so as to form a plurality of jewelry storage compartments therewithin;

wherein each said jewelry storage compartment has at least one support post for supporting one or more strands of jewelry;

a support hook, connected to said case housing, for supporting said case housing from a closet rod; and a front cover panel for positioning over said access opening so as to close off said interior volume and cover said plurality of jewelry storage compartments;

wherein each support post contacts the rear surface of said front cover panel in order to prevent supported articles of jewelry from sliding off said support post when said front cover panel is closed and said jewelry case is being transported or otherwise subjected to external forces, as experienced when moving clothes around in a closet environment.

12. The jewelry case of claim 11, wherein each said jewelry storage compartment has a jewelry storage tray integrated therewith beneath said fixed front wall portion for storage of jewelry items.

13. The jewelry case of claim 12, wherein each said partition panel has a slot formed therein slightly above said fixed front wall portion, and said front cover panel has a tray cover panel projecting orthogonally from the bottom inside surface thereof and slides into said slots formed within said partition panels when said front cover panel is positioned over said access opening, thereby closing off and containing articles of jewelry placed within each said jewelry storage tray.

14. The jewelry case of claim 11, wherein said front cover panel is hingedly connected to said case housing.

15. The jewelry case of claim 11, wherein each said jewelry storage compartment comprises a pair of spaced apart support posts mounted to said back wall portion, for supporting strands of jewelry.

16. The jewelry case of claim 11, where the distance between said pair of support posts within each said jewelry storage compartment is user adjustable to accommodate the length of said jewelry strands being supported on said support posts.

17. The jewelry case of claim 11, wherein the upper portion of each said partition panel is tapered to facilitate placement of jewelry strands about said support post within said jewelry storage compartment.

18. A jewelry case for storing and organizing articles of jewelry, comprising:

a case housing having a form factor for supporting, and being substantially concealed by a garment, said case housing having an interior volume, an access opening leading thereinto, and a plurality of jewelry storage compartments extending parallel within said interior volume, wherein each said jewelry storage compartment has at least one support post for supporting one or more strands of jewelry;

a support hook, connected to said case housing, for supporting said case housing from a closet rod; and a front cover panel for positioning over said access opening so as to close off said interior volume and cover said plurality of jewelry storage compartments; and wherein each support post contacts the rear surface of said front cover panel in order to prevent supported articles of jewelry from sliding off said support post when said front cover panel is closed and said jewelry case is being transported or subjected to external forces when said jewelry device is moved around in a closet environment.

19. The jewelry case of claim 18, wherein each said jewelry storage compartment has a jewelry storage tray integrated therewith beneath said fixed front wall portion for storage of jewelry items.

20. The jewelry case of claim 19, wherein said front cover panel has a tray cover panel which closes off said jewelry storage trays and contains articles of jewelry placed therewithin when said front cover panel is closed over said access opening.

21. A jewelry case for storing and organizing articles of jewelry, comprising:

a case housing having a form factor for supporting, and being substantially concealed by a garment, said case housing having an interior volume, an access opening leading thereinto, a fixed front wall portion and a plurality of jewelry storage compartments extending parallel within said interior volume, wherein each said jewelry storage compartment has at least one support post for supporting one or more strands of jewelry;

a support hook, connected to said case housing, for supporting said case housing from a closet rod while enabling said case housing to be rotatably supported thereabout; and a front cover panel for positioning over said access opening so as to close off said interior volume and cover said plurality of jewelry storage compartments; and wherein each said jewelry storage compartment has a jewelry storage tray integrated therewith beneath said fixed front wall portion for storage of jewelry items.

22. The jewelry case of claim 21, wherein said front cover panel has a tray cover panel which closes off said jewelry storage trays and contains articles of jewelry placed therewithin when said front cover panel is closed over said access opening.

23. The jewelry case of claim 21, wherein each support post contacts the rear surface of said front cover panel in order to prevent supported articles of jewelry from sliding off said support post when said front cover panel is closed and said jewelry case is being transported or subjected to external forces when said jewelry device is moved around in a closet environment.

24. A jewelry case for storing and organizing articles of jewelry, comprising:

a case housing having a form factor for supporting, and being substantially concealed by a garment, said case housing having a number of housing portions including a back panel portion, a pair of side wall portions extending from and connected to said back wall portion, a bottom wall portion extending from and connected to said side wall portions, a top wall portion extending from and connected to said bottom wall portion and also being connected to said side wall portions so as to define an interior volume having an access opening, and a fixed front wall portion connected to said bottom wall portion, and disposed substantially parallel to said back wall portion, and extending between said side wall portions, beneath said access opening;

a plurality of partition panels projecting from said back wall panel and running in a parallel manner within said interior volume so as to form a plurality of jewelry storage compartments therewithin;

wherein each said jewelry storage compartment has at least one support post for supporting one or more strands of jewelry;

wherein at least one jewelry storage tray is integrated beneath said fixed front wall portion for storage of jewelry items;

a support hook, connected to said case housing, for supporting said case housing from a closet rod; and a front cover panel for positioning over said access opening so as to close off said interior volume and cover said plurality of jewelry storage compartments and said at least one jewelry storage tray.

25. The jewelry case of claim 24, wherein each said partition panel has a slot formed therein slightly above said fixed front wall portion, and said front cover panel has a tray cover panel projecting orthogonally from the bottom inside surface thereof and slides into said slots formed within said partition panels when said front cover panel is positioned over said access opening, thereby closing off and containing articles of jewelry placed within said at least one jewelry storage tray.

26. The jewelry case of claim 25, wherein said front cover panel is hingedly connected to said case housing.

27. The jewelry case of claim 24, wherein each said jewelry storage compartment comprises a pair of spaced apart support posts mounted to said back wall portion, for supporting strands of jewelry.

28. The jewelry case of claim 27, where the distance between said pair of support posts within each said jewelry storage compartment is user adjustable to accommodate the length of said jewelry strands being supported on said support posts.

29. The jewelry case of claim 24, wherein the upper portion of each said partition panel is tapered to facilitate placement of jewelry strands about said support post within said jewelry storage compartment.

30. The jewelry case of claim 24, wherein said support hook is detachable from said case housing.

31. The jewelry case of claim 24, wherein the surfaces bounded within each said jewelry storage compartment are provided with a soft-textured material to reduce scratching of articles of jewelry stored therewithin.

32. The jewelry case of claim 24, wherein said back panel is further provided with at least one mounting hole for passage of a screw to mount said case housing to a wall surface.

33. The jewelry case of claim 24, wherein each support post contacts the rear surface of said front cover panel in order to prevent supported articles of jewelry from sliding off said support post when said front cover panel is closed and said jewelry case is being transported or otherwise subjected to external forces, as experienced when moving clothes around in a closet environment.

34. A jewelry case for storing and organizing articles of jewelry, comprising:

a case housing having a form factor for supporting, and being substantially concealed by a garment, said case housing having an interior volume, an access opening leading thereinto, a fixed front wall portion and a plurality of jewelry storage compartments extending parallel within said interior volume, wherein each said jewelry storage compartment has at least one support post for supporting one or more strands of jewelry;

a support hook, connected to said case housing, for supporting said case housing from a closet rod; and a front cover panel for positioning over said access opening so as to close off said interior volume and cover said plurality of jewelry storage compartments; and wherein each support post contacts the rear surface of said front cover panel in order to prevent supported articles of jewelry from sliding off said support post when said front cover panel is closed and said jewelry case is being transported or subjected to external forces when said jewelry device is moved around in a closet environment.

35. The jewelry case of claim 34, wherein each said jewelry storage compartment has at least one jewelry storage tray integrated within said case housing, beneath said fixed front wall portion, for storage of jewelry items.

36. The jewelry case of claim 34, wherein said front cover panel has a tray cover panel which closes of said jewelry storage trays and contains articles of jewelry placed therewithin when said front cover panel is closed over said access opening.

* * * * *